United States Patent [19]

Knapstein et al.

[11] 4,275,850

[45] Jun. 30, 1981

[54] PLATE-TYPE PAINT GRINDING MACHINE AND ITS USE IN PIGMENT TESTING

[75] Inventors: Bruno Knapstein, Cologne; Friedrich Vial, Leichlingen, both of Fed. Rep. of Germany

[73] Assignee: Kronos Titan G.m.b.H., Leverkusen, Fed. Rep. of Germany

[21] Appl. No.: 44,564

[22] Filed: Jun. 1, 1979

[30] Foreign Application Priority Data

Apr. 24, 1979 [DE] Fed. Rep. of Germany ..... 2824163

[51] Int. Cl.[3] ..... B02C 19/00

[52] U.S. Cl. ..... 241/57; 241/252; 241/266

[58] Field of Search ..... 366/605; 241/57, 203, 241/205, 206, 220, 244, 601, 250, 237, 266, 251, 252, 253, 283

[56] References Cited

U.S. PATENT DOCUMENTS

| | | | |
|---|---|---|---|
| 1,717,860 | 6/1929 | Warren | 241/250 X |
| 3,175,808 | 3/1965 | Dedoes | 366/605 X |

FOREIGN PATENT DOCUMENTS

| | | | |
|---|---|---|---|
| 2319955 | 11/1974 | Fed. Rep. of Germany | 241/244 |
| 464329 | 7/1975 | U.S.S.R. | 241/244 |

*Primary Examiner*—Mark Rosenbaum

*Attorney, Agent, or Firm*—Gary M. Nath

[57] ABSTRACT

A grinding apparatus having two mulling plates disposed horizontally in superposed relation is provided. The lower mulling plate is connected to suitable drive means for rotating the plate (the direction of rotation is reversed intermittently). The upper mulling plate is eccentrically connected to a support structure and is provided with a guide pin connected at one end to the plate and which extends at the other end through a slot in the support structure. In operation, the lower mulling plate upon rotation effects movement of the upper mulling plate about its eccentric axes, but the extent of travel of the upper mulling plate is controlled or limited by the guide pin which contacts one end or the other of the slot in the support member. The apparatus is useful for grinding pigment and paint.

10 Claims, 6 Drawing Figures

PLATE-TYPE PAINT GRINDING MACHINE AND ITS USE IN PIGMENT TESTING

FIELD OF THE INVENTION

The present invention concerns a grinding apparatus. More specifically, the invention is directed to a plate-type paint grinding apparatus especially adapted for use in pigment testing, in particular in preparing pigment pastes in which the pigments are tested.

BACKGROUND OF THE INVENTION

In many tests in which pigments are examined, the pigments must be made into pastes. Such tests are described in various standard specifications of the German Industrial Standards Committee, e.g. DIN 53165 (Determination of the Relative Scattering Power of White Pigments), DIN 53191 and 53192 (Determination of Lightening Power of White Pigments), DIN 53204 (Determination of the Relative Tinting Strength of Colored Pigments), DIN 53238 (Examination of Dispersibility), parts 11 and 20, and DIN 53239 (Determination of Fineness-of-Grind during Dispersion in an Automatic Muller).

The pastes are ground in a plate-type paint grinding apparatus. The main features of the apparatus include two circular mulling plates, preferably made of glass or covered with glass plates, which are positioned coaxially one above the other in a horizontal attitude. A drive gear positioned below the lower plate cooperatively engages the lower plate to revolve that plate in one direction about its central axis. The upper plate does not revolve about its central axis; it can, however, be folded or raised upwards to feed the paint grinding apparatus. The paint grinding apparatus is further equipped with a mechanism to apply a specified load which can, if required, be exerted by the upper plate on the lower plate. Preferably, one of the two plates, usually the upper one, can be cooled or heated. Such a plate-type paint grinding machine is, for instance, known under the name of "Automatic Muller," manufactured by J. Engelsmann AG, D-6700 Ludwigshafen/West Germany, and sold, for instance, by A. M. Erichsen, G.m.b.H., D-5870 Hemer-Sundwig/West Germany; cf. their brochure "Prufgerate fur die Lack+Farben herstellende und verarbeitende Industrie Lieferprogramm 1964" (Testing instruments for the paint making and processing industry, 1964 production program), page 6, type No. 354.

The above apparatus employed heretofore requires the following sequence of operation. The paste is made in such a manner that first, with the upper plate folded upwards, the exactly defined quantities of a paste and the pigment to be examined are placed on the lower plate and mixed by hand with a spatula. Then the upper plate is put down, with the prescribed load applied if required, and the lower plate is set in motion. After a specified number of revolutions of the lower plate operation has to be interrupted and the paste homogenized by hand with the aid of a spatula. After the same procedure has been repeated, if needed several times, the mixture is collected from the paint grinding machine and processed further for testing.

Interruption of the machine during grinding of the paste is required because the mixture tends to separate while the lower plate is in motion so that, in places, higher pigment concentrations will occur. These inhomogeneities must be removed by hand. This procedure is time consuming and, because of the manua work involved, expensive. These disadvantages provid serious drawbacks when testing a large number of pig ment or paint samples.

The present invention avoids the foregoing disadvan tages, particularly the interruption of the machine oper ation and eliminates the need to homogenize the past by hand during the periods of interrupted machine op eration.

THE INVENTION

The problem is solved by the invention with a plate type paint grinding machine featuring two circula mulling plates arranged one above the other, thei working faces running on the horizontal and the lowe plate revolving about its central axis on a shaft which i fitted in a support provided with a driving gear. Thi plate-type paint grinding machine is characterized i that the driving gear is provided with a control devic which reverses the sense of rotation of the lower plat at predetermined intervals, and that the upper plate i fitted in a holder located above it, where the plate i able to revolve about a vertical eccentric axis of rota tion, with the axis of rotation meeting the lower plate i a point outside its center, and that, moreover, the uppe plate features a pivot positioned on this plate on th straight line passing from the axis of rotation through it central axis, the pivot projecting into a slot cut into th support of the upper plate where it can travel freely, th slot providing a horizontal arc about the eccentric axi of rotation of the upper plate and being limited by tw end points lying within the periphery of the lower plate.

The invention will be more readily understood from the detailed description thereof herebelow, particularly with reference to the accompanying drawings wherein.

DETAILED DESCRIPTION OF THE INVENTION

Figure 1:
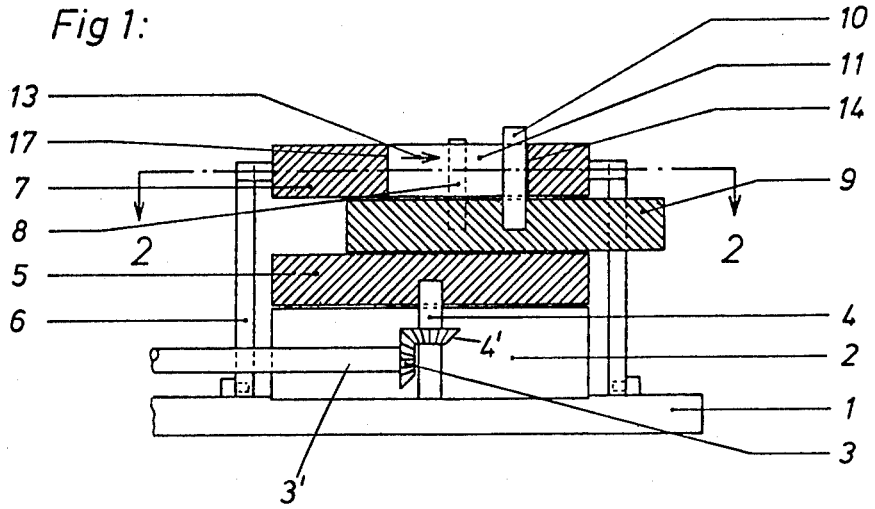
FIG. 1 is a schematic diagram depicting an elevation view of the apparatus.
Figure 2:
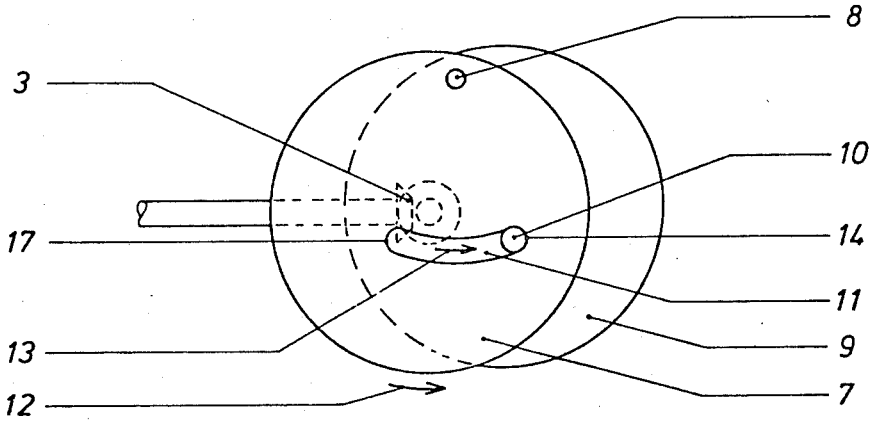
FIG. 2 is a cross-sectional view along plane 2—2 through FIG. 1.
Figure 3:
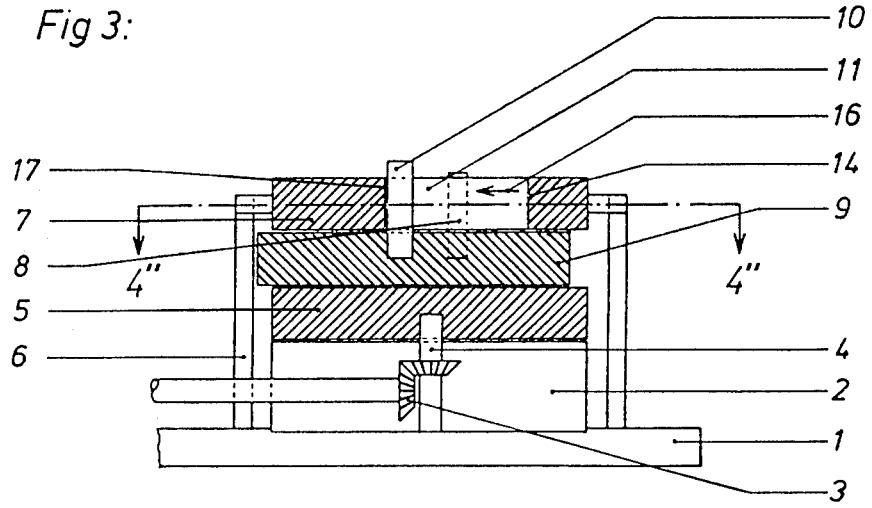
FIG. 3 is a schematic diagram similar to FIG. 1 which depicts an elevation view of the apparatus, wherein the bottom plate of the apparatus is made to rotate in a direction opposite that of FIG. 1.
Figure 4:
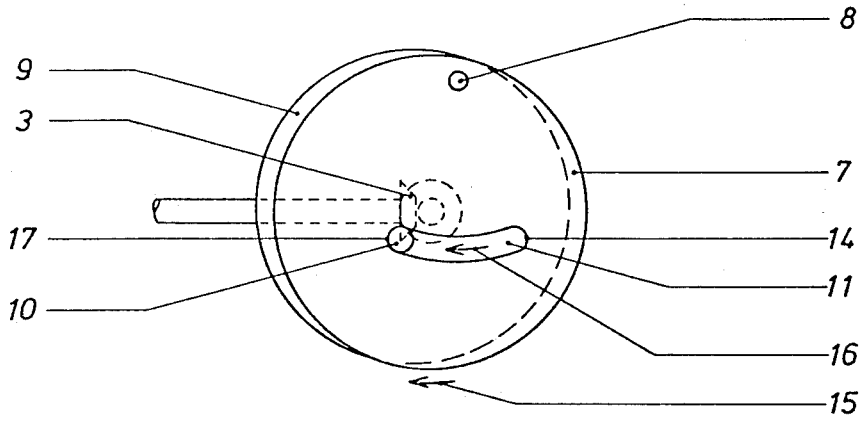
FIG. 4 is a cross-sectional view along plane 4"–4" through FIG. 3.
Figure 5:
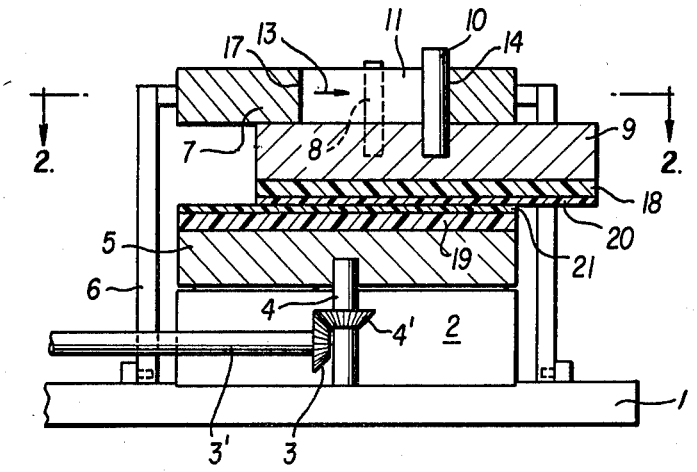
FIG. 5 is a schematic diagram depicting an elevation view having working faces with removable sheets.

FIGS. 1 and 2 show the machine in the relative position of the two mulling plates taken when the bottom plate rotates in the direction of arrow 12. The upper plate has been deflected in relation to the bottom plate. FIGS. 3 and 4 show the device when the bottom plate has been rotated in the other direction shown by arrow 15. The upper plate is deflected in the other direction in relation to bottom plate.

Referring to FIG. 1, the machine comprises a base member (1) to which is connected by suitable means (not shown) a support member (2). Lower mulling plate (5) is supported by support member (2) and so constructed and arranged so as to be rotatable thereon. Specifically, rotatable shaft member (4) extends vertically or upwardly from support member (2) and extends one end into a recess in the bottom of lower mulling ate (5); shaft member (4) is coaxially aligned with wer mulling plate (5). The lower end of shaft member ) is suitably journaled for rotation in a recess in base ember (1). A gear member (4') is secured to shaft ember (4) and is adapted to cooperatively engage a ive gear (3) at the end of a drive shaft (3'). Drive shaft ') is adapted to be connected to suitable conventional ive means, e.g., an electric motor (not shown), hereby rotational movement of drive shaft (3') is ansmitted through gears (3) and (4') and shaft member ) to rotate lower mulling plate (5). Also mounted on ise member (1) is a frame member (6) supporting a older member (7). The upper mulling plate (9) is atched to holder member (7) by means of an eccentrilly located axis pin (8) about which it can rotate. ttached to the upper mulling plate (9) is a pivot memr (10) which is preferably positioned in a ball bearing. vot member (10) projects into a slot (11) cut into the older member (7). The pivot member (10) is adapted to sily run in the slot (11) because of its preferred ball aring connection in upper mulling plate (9). The ame member (6) is movable allowing the holder memr (7) together to be folded or raised upwards. The per mulling plate (9) contains a feed and a discharge ening (not shown) for a liquid by means of which it n be cooled or heated.

Figure 6:
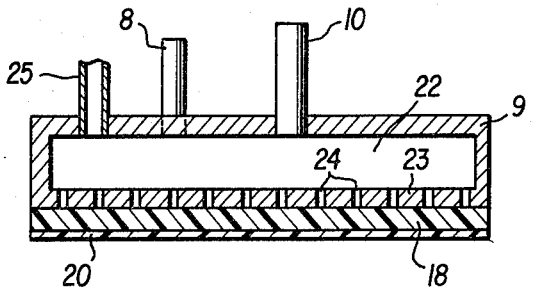
FIG. 6 is a diagram depicting an upper mulling plate having a cavity.

In FIGS. 1 and 2 the lower mulling plate (5) turns in e direction marked by the arrow (12). By the friction oduced between mulling plates (5) and (9) the upper ate (9) is deflected so that the pivot member (10) oves in the slot (11) in the direction of the arrow (13) be halted in the end point (14) of the slot (11) until the nse of rotation of the lower mulling plate (5) is rersed. Then the lower mulling plate (5) turns in the rection marked by the arrow (15) in FIG. 4. By the ction produced between the two mulling plates, the per mulling plate (9) is now deflected in the other rection so that the pivot member (10) travels from the d point (14) of the slot (11) in the direction of the row (16) until it reaches the other end point (17) of the t (11) where it is halted until the direction of the wer mulling plate (5) is reversed once more. In FIG. the working faces between mulling plates (5) and (9) e covered with discs (18) and (19) consisting of a astic material which is self-adhesive on both sides and sily removable. Discs (18) and (19) in turn are coved with easily removable thin plastic sheet (20) and 1). In FIG. 6, the upper mulling plate (9) has a cavity 2) which on one side is connected to the atmosphere way of holes (24) in the working face (23) and on the her side is connected to a vacuum pump by means of e (25) whereby a vacuum can be produced in the lling plates.

The following example shall serve to explain the vention:

An automatic muller, i.e., a plate-type paint grinding chine, was used whose mulling plates (5) and (9) had liameter of 25 cm. The eccentric axis of rotation (8) is positioned in the holder member (7) at a distance of m from the periphery of the upper mulling plate (9). e upper mulling plate (9) was fastened to the holder mber (7) by axis pin (8) so that it was able to rotate. e pivot member (10) was positioned at a distance of cm from the axis of rotation (8) on the straight line ssing from the axis of rotation through the central axis the upper mulling plate (9). It had a diameter of 3 cm. e slot (11) was cut in the form of an arc at a distance of 8.5 cm about the eccentric axis of rotation (8); it was 3 cm wide. The two end points (14) and (17) of the slot (11) were located in such a way that at the end point (17) the pivot member (10) met the straight line passing from the eccentric axis of rotation (8) through the central axis of the holder member (7), while the arc of the slot (11), measured between its end points (14) and (17), had a length of 11.7 cm so that the path travelled by the pivot member (10) had a length of 8.7 cm. The axis of rotation (8) of the upper mulling plate (9) was positioned in a ball bearing.

This automatic muller was used to prepare a grey paste in which the relative scattering power of a $TiO_2$ pigment was determined by the German standard method DIN 53165.

1.9 g $TiO_2$ pigment and 2.5 g black paste were placed on the lower plate (5) and then mixed with an elastic spatula until thoroughly wetted. The upper mulling plate (9) was put down without an additional load. The lower mulling plate (5) was then set in motion; it completed a total of 55 revolutions, the sense of rotation of the lower plate was reversed after every 5 revolutions. This method gave a good paste without requiring machine operation to be interrupted to homogenize the mixture by hand.

To produce the same effect with a conventional plate-type paint grinding machine with fixed upper plate, the lower plate had to be stopped after 25 revolutions for the mixture to be moved by hand to the center of the lower plate by means of a spatula before the plate was once more set in motion to complete another 25 revolutions.

The machine of the invention operates in the following manner. When the lower mulling plate is set in motion it carries the upper mulling plate along by friction as it turns in the one direction. Because of the eccentric position of its axis of rotation, the upper mulling plate is deflected, moving out and pulling the pivot member along. The pivot member travels along in the arc-shaped slot cut in the holder member of the upper mulling plate until it reaches the end of the slot. The pivot member prevents the upper mulling plate from being deflected further so that it remains in this position until the sense of rotation of the lower mulling plate is reversed after the predetermined interval of time. When now the lower mulling plate rotates in the opposite direction, the upper mulling plate is again carried along by friction, the pivot member travelling along in the slot to its other end where the upper mulling plate is halted in the new position until the lower mulling plate once more reverses its sense of rotation.

This movement of the upper mulling plate is repeated as the sense of rotation of the lower mulling plate is reversed. During its travelling movement and when the upper mulling plate is halted at the end of the travelling movement, different types of grinding processes are taking place between the two mulling plates, which influence the dispersion of the mixture between the two plates.

The machine as invented is particularly suited to be used in pigment testing.

The machine as invented allows the test mixtures to be homogenized solely by automatic machine operation without separation of the plates and homogenization by hand at certain intervals. This reduces the time spent on producing the mixture. The laboratory technician is, moreover, free to carry out other tasks while the mixture is being homogenized; this means considerable savings in time and costs especially when larger test series are run. The process of dispersion and homogenization can also be automated quite easily.

When pigments are rubbed up by means of the plate-type paint grinding machine of the invention, the following procedure is applied: Paste and pigment are placed on the lower plate in the desired quantities and mixed by hand. Then the mixture is dispersed and homogenized by starting the lower mulling plate to rotate, its sense of rotation being reversed at predetermined intervals. After a predetermined number of phases has been completed, the finished mixture is collected from the paint grinding machine.

The reversal of the sense of rotation of the lower mulling plate at predetermined intervals and the deflection of the upper mulling plate result in improved dispersion of the pigment in the paste and effectively prevent the occurrence of inhomogeneities or quickly remove such inhomogeneities.

A favorable embodiment of the apparatus of the invention is characterized in that the slot (11) is provided with one or two adjustable stops, which allow the path of the pivot member (10) to be restricted. This allows the machine easily to be adapted to different requirements in that the deflection of the upper mulling plate can be adjusted to be wider or narrower, which means that the homogenizing effect brought about by the deflection of the upper mulling plate can be controlled.

A further favorable embodiment of the apparatus of the invention is characterized in that elastic halting plates are arranged at the ends of the slot (11) or the slot section in which the pivot member (10) can travel. These halting plates may protrude or extend more or less from both ends of the slot or the slot section into the slot or slot section in which the pivot member (10) is allowed to travel. As soon as with the movement of the upper mulling plate the pivot member (10) reaches one of the two halting plates, an elastic force acts counter to the further movement of the pivot member and thus the upper mulling plate. This produces an additional frictional force between the two plates, which in size is relative to the elastic strength of the halting plate pushed back by the pivot member. The consistency of the paste automatically regulates the dispersion of the pigment in the paste and their homogenization. If, for example, in the beginning, the paste is still cold and stiff, then the deflection of the upper mulling plate is large because of the relatively high friction produced between the two plates and the relative movement between the two plates is large; the mixture is ground with great intensity. When the mixture warms up, the deflection of the upper mulling plate becomes smaller because the frictional force exerted by the lower mulling plate on the upper mulling plate, which carries the upper plate along, is getting smaller; the deflection decreases as the lower mulling plate continues to rotate in the same direction, and so does the relative movement between the two plates and thus the force it exerts on the mixture.

An advantageous embodiment of the invention is characterized in that the working faces of the two mulling plates are covered with discs consisting of a plastics material which is self-adhesive on both sides and easily removable. These discs, in turn, are covered with an easily removable thin plastics sheet.

In this embodiment of the invention, the paste and the pigment are placed on one of the thin plastics sheets. This plastics sheet is fastened on the lower mulling plate with the aid of one of the self-adhesive plastics discs. A second plastics sheet is fastened to the upper mulling plate by means of the other self-adhesive disc. At completion of grinding, the finished mixture is removed from the plastics sheets. The sheets are then removed from the plates and can be discarded. This saves the costs of cleaning, which may otherwise be quite substantial.

The thin plastics sheets cannot be applied to the plates directly as they will slip away when the machine is in operation. The self-adhesive plastics discs are therefore of considerable importance. These discs are available on the market, being sold e.g. under the name of "Non Slip Folien," i.e., "Non-slip" sheets or films, by companies like Dipl.-Ing. Spirig, Rapperswil/Switzerland and Kager Verfahrenstechnik, D-6000 Frankfurt (Main)/West Germany. The plastics sheets may be made of any sort of material, particularly of inexpensive ones as e.g. polyethylene; it is however essential that during the dispersion and homogenizing process such material does not give off any of its constituents into the mixture and that it does not tear.

In this embodiment of the invention, the upper mulling plate may feature a cavity which on the one side is connected to the atmosphere by holes in the working face and on the other side to a vacuum pump by means of a tube so that a vacuum can be produced in the plate. By means of the vacuum the plastics disc can be held particularly fast on the upper plate.

What is claimed is:

1. Apparatus adapted for grinding which comprises a base member; a first mulling plate disposed horizontally on said base member; a support member connected to said base member for engaging and supporting a second mulling plate disposed horizontally and in superposed relation to said first mulling plate; guide means disposed on said second mulling plate and operatively engaging stop means cooperatively disposed on said support member and drive means adapted upon actuation to rotate said first mulling plate thereby to rotate said second mulling plate until said guide means engage said stop means thereby to limit the movement of said second mulling plate in relation to said first mulling plate.

2. The apparatus of claim 1 wherein said guide means comprise a pin member connected at one end to said second mulling plate and extending at its other end into an arcuate slot comprising the stop means in said support member.

3. The apparatus of claim 1 or 2 having a plastic member adhered to the surface of said first mulling plate which faces said second mulling plate.

4. The apparatus of claim 3 having a plastic member adhered to the surface of said second mulling plate which faces said first mulling plate.

5. The apparatus of claim 1 having control means connected to said drive means for reversing the direction of rotation of said first mulling plate.

6. Apparatus in accordance with claims 1 or 2, characterized in that elastic halting plates are provided at either end of the slot or slot section in which the pivot guide pin is allowed to travel.

7. Apparatus in accordance with claims 1 or 2 wherein the two mulling plates working faces are covered with an easily removable thin adherent plastic sheet.

8. Apparatus in accordance with claim 7 wherein the upper mulling plate has a cavity which on the one side is connected to the atmosphere by way of holes in the working face and on the other side is connected to a vacuum pump by means of a tube whereby a vacuum can be produced in the mulling plate.

9. Apparatus for grinding which comprises two circular mulling plates disposed horizontally in superposed relation on a base member wherein a lower mulling plate is adapted to revolve about a central axis on a shaft operatively connected to a driving gear connected to said base member; control means connected to said driving gear for reversing the direction of rotation of said lower mulling plate at predetermined intervals; a support member connected to said base member and eccentrically engaging an upper mulling plate whereby said upper mulling plate is adapted to revolve eccentrically in relation to said lower mulling plate; a pivot guide pin connected to said upper mulling plate on a straight line passing from its axis of rotation through its central axis; said pivot projecting into an arcuate slot in said support member and adapted to travel freely therein wherein said slot provides two end points within the lower mulling plate for limiting the extent of movement of said upper mulling plate upon contact therewith of said pivot guide pin.

10. Apparatus in accordance with claim 9 wherein an adjustable stop is provided in the slot to restrict the movement of the pivot guide pin.

* * * * *

UNITED STATES PATENT OFFICE

CERTIFICATE OF CORRECTION

Patent No. 4,275,850 Dated June 30, 1981

Inventor(s) Bruno Knapstein et al

It is certified that error appears in the above-identified patent and that said Letters Patent are hereby corrected as shown below:

[30] The foreign application priority date "April 24, 1979" should read --June 2, 1978--.

Signed and Sealed this

*Twenty-second* Day of *September 1981*

[SEAL]

*Attest:*

GERALD J. MOSSINGHOFF

*Attesting Officer*

*Commissioner of Patents and Trademarks*